United States Patent [19]

Ennis, III

[11] Patent Number: 4,852,772

[45] Date of Patent: Aug. 1, 1989

[54] DISPENSER FOR VISCOUS FLUIDS

[75] Inventor: James F. Ennis, III, Preston, Conn.

[73] Assignee: Genesis Industries, Incorporated, Spring Valley, Wis.

[21] Appl. No.: 129,447

[22] Filed: Dec. 7, 1987

[51] Int. Cl.[4] ..... B67D 5/42

[52] U.S. Cl. ..... 222/386; 222/327

[58] Field of Search ..... 222/386, 386.5, 326, 222/327, 387; 604/124, 125

[56] References Cited

U.S. PATENT DOCUMENTS

| | | | |
|---|---|---|---|
| 1,557,837 | 10/1925 | Hein | 604/125 |
| 3,291,128 | 12/1966 | O'Neil | 222/386 X |
| 3,809,298 | 5/1974 | Harris, Sr. et al. | 222/386 |
| 3,960,139 | 6/1976 | Bailey | 604/125 X |
| 4,057,050 | 11/1977 | Sarstedt | 222/386 X |
| 4,206,768 | 6/1980 | Bailey | 604/125 X |
| 4,715,854 | 12/1987 | Vaillancourt | 604/125 X |

FOREIGN PATENT DOCUMENTS

| | | | |
|---|---|---|---|
| 234184 | 5/1925 | United Kingdom | 222/386 |

*Primary Examiner*—Michael S. Huppert

*Attorney, Agent, or Firm*—Edward H. Loveman

[57] ABSTRACT

This dispenser for a viscous fluid comprises a cylindrical barrel having a nozzle at one end thereof for passing a fluid to fill the barrel and to discharge the fluid from the barrel. A flexible cylindrical piston head fits frictionally in the barrel to seal the fluid therein. The piston head is moved axially to discharge the fluid from the barrel. A multiplicity of short passages are defined by ridges or formed by narrow grooves on or in the inside wall of the barrel near the nozzle. The passages are only slightly longer than the axial length of the piston head to pass air entrapped between the piston head and fluid, axially of the barrel passed the piston head. The fluid fills the barrel and abuts the piston head, so that no air bubbles are discharged with the fluid from the nozzle. The hardness of the piston head is such that the sides of the head do not enter the passages which remain unobstructed. When the piston head is moved beyond the passages, the barrel is sealed by the flexible piston head and the fluid cannot leak passed the head even when heavy pressure is applied to the piston head to discharge the fluid from the barrel.

5 Claims, 3 Drawing Sheets

DISPENSER FOR VISCOUS FLUIDS

BACKGROUND OF THE INVENTION

1. Field of the Invention

This invention relates to the art of dispensers of viscous fluids such as heavy oils, grease, caulking compound, mastic, putty, paste, and other fluids of high viscosity. More particularly the invention concerns viscous fluid dispensers such as syringes, grease guns, caulking guns and cartridges, and similar devices each containing an axially movable piston or plunger for discharging a heavy fluid or semifluid from a nozzle at one end of the dispenser. The invention is especially directed at a dispensing device of the type mentioned wherein the device has a cylindrical barrel containing the fluid material to be discharged from the nozzle, which barrel is filled by hydraulically or pneumatically injecting the viscous fluid through the nozzle.

2. Description of the Prior Art

Viscous fluid dispensers of the type mentioned above heretofore known, which are filled with fluid via the nozzle, have had the objectionable characteristic that air is generally entrapped at the piston head or seal when the dispenser barrel is filled with fluid. This entrapped air causes the following difficulties:

A. The exact desired dose of fluid cannot be discharged or administered because some or all doses contain air entrapped in the dispenser during the filling procedure.

B. The presence of the entrapped air further complicates the accuracy of calculation of the dose, because the entrapped air is easier to compress than the viscous fluid. The precise movement of the piston head or seal axially in the barrel of the dispenser is often taken as a measure of the dosage being dispensed, but this calculation is rendered inaccurate because it does not take into account the quantity of air in the barrel entrapped between the piston head and fluid.

C. The air compressed by the piston during the last administered or discharged doses of fluid, expands after forward discharging movement of the piston stops. This expanding air causes undesirable drooling, dripping, or leakage of fluid from the nozzle of the dispenser.

It has been proposed in U.S. Pat. No. 3,291,128 issued to J.G. O'Neill, dated Dec. 13, 1966, to remedy this problem of air entrapment by providing a very flexible, soft piston head, moved along fine grooves or ridges extending the full length of the barrel. The soft material of the piston head enters and seal the grooves or passages between ridges. Entrapped air is released by twisting the head circumferentially of the barrel. This design has not proved wholly satisfactory in practice for two reasons. Firstly, due to the required softness of the piston head, parts of the piston head sealing the grooves or passages are pushed out of the grooves when pressure is applied to the head to discharge fluid by advancing the head in the barrel. This condition allows the fluid in the barrel to leak backward out throught the long grooves or passages. Secondly, when the head is rotationally twisted, air and fluid both flow rearwardly through the grooves or passages and the fluid undesirably leaks out of the barrel.

SUMMARY OF THE INVENTION

The present invention is directed at overcoming the above mentioned and other difficulties and disadvantages of the syringe described in the O'Neill U.S. Pat. No. 3,291,128, and of other fluid dispensers where air may be entrapped when filling the barrels. According to the invention short, shallow fine air passages are provided between the interior wall of the dispenser barrel and the frictionally fitted cylindrical flexible piston head adjacent the nozzle to prevent entrapment of air during filling of the dispenser barrel with fluid. The short passages are fine so that entrapped air may pass or bleed through them but the fluid or paste is prevented by its high viscosity from passing through the fine passages. The passages may be defined by narrow ridges on the interior wall of the dispenser barrel. The ridges are spaced apart circumferentially of cylindrical the barrel and extend a short distance longitudinally or axially of the barrel. This distance does not exceed twice the length of the piston head at the inside wall of the barrel, and the distance may be as small at 100.25% of the axial length of the piston head at the barrel wall. The ridges which define the radially short, arcuate passages may be axially ramped or wedge shaped to facilitate movement of the flexible, sealing piston head along the ridges. The air passages may be defined by short, shallow, narrow, fine grooves in the interior wall of the barrel. The lengths of these grooves will not exceed twice the axial length of the piston head at the inside wall of the barrel, and the distance may be shorter, but not shorter than 100.25% of the axial length of the piston head at the barrel wall to pass entrapped air. While piston head is flexible to frictionally grip the inside wall of the barrel and the ridges, the head has sufficient hardness so that it will not enter the fine passages or grooves at any time, to permit the air to bleed past the piston head while excluding the viscous fluid.

When the dispenser is being filled with a viscous fluid via the nozzle of the dispenser, the fluid pushes entrapped air ahead of it. This entrapped air passes through the fine axial passages or grooves so that the fluid fills the dispenser barrel completely in abutment with the facing head of the piston head to move the piston or plunger axially rearwardly in the barrel until filling of the barrel with fluid is complete.

No entrapped air remains to interfere with the prefect seal between the fluid and piston head. When the piston head or plunger is moved axially rearwardly beyond the fine passages, the flexible head makes a perfect seal with the interior wall of the barrel so that no fluid can leak passed the piston head at any time. This construction avoids one disadvantage of the abovementioned prior O'Neill syringe, where the soft piston head enters the fine grooves, and is undesirably pushed aside when pressure is applied to the piston head upon forward movement to discharge the fluid from the barrel, so that the fluid leaks rearwardly beyond the piston head, out of the barrel. Also this construction does not require twisting the piston head or plunger as does O'Neill's to discharge entrapped air from the barrel. When such twisting is performed with prior syringes, air and fluid are both passed around the piston head and leakage of fluid undesirable occurs in the barrel.

These and other objects and many of the attendant advantages of this invention will be readily appreciated as the same becomes better understood by reference to the following detailed description when considered in connection with the accompanying drawings in which:

Figure 1:
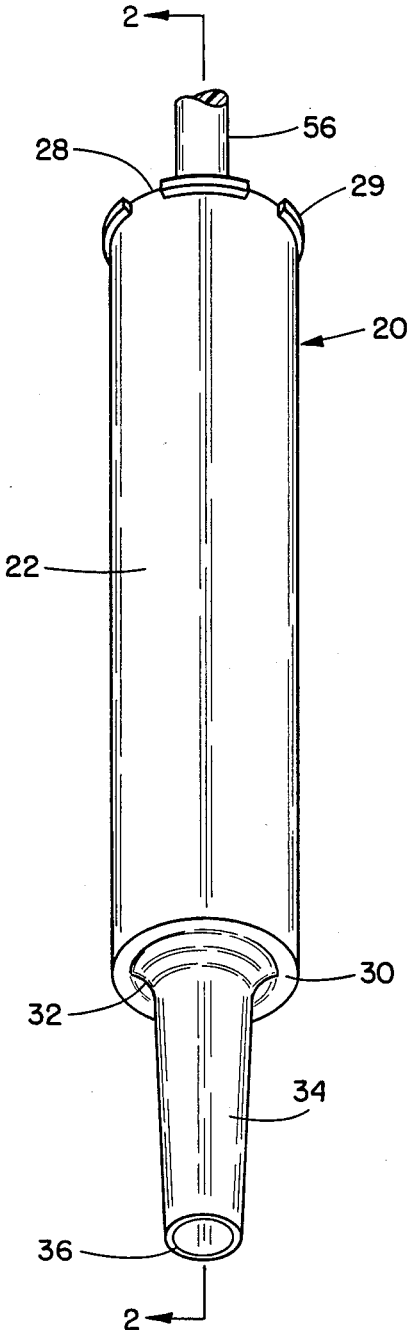
FIG. 1 is an isometric view of a viscous fluid dispenser such as a cartridge of a caulking gun, or a syringe embodying the invention.
Figure 2:
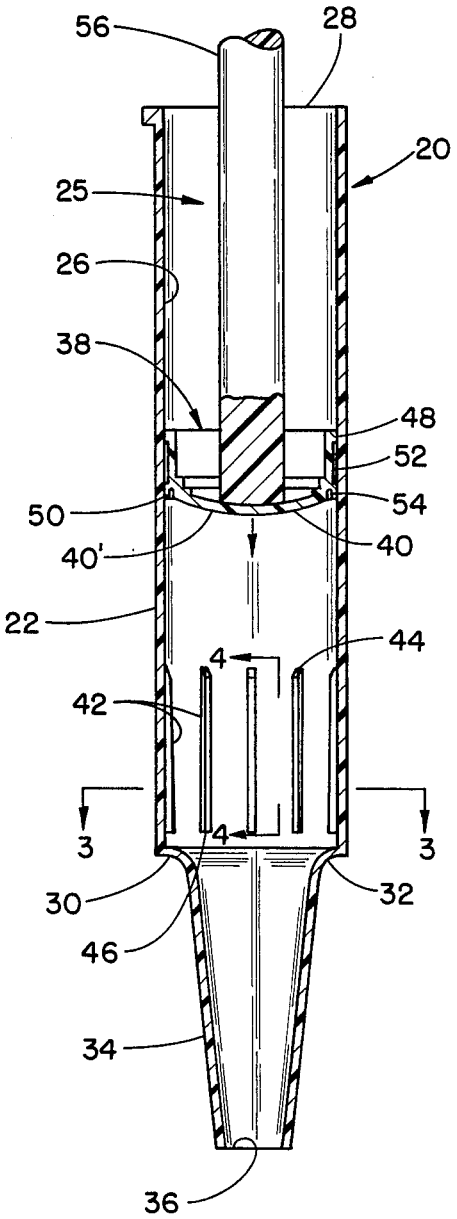
FIG. 2 is an axial sectional view taken along line 2—2 of FIG. 1.
Figure 3:
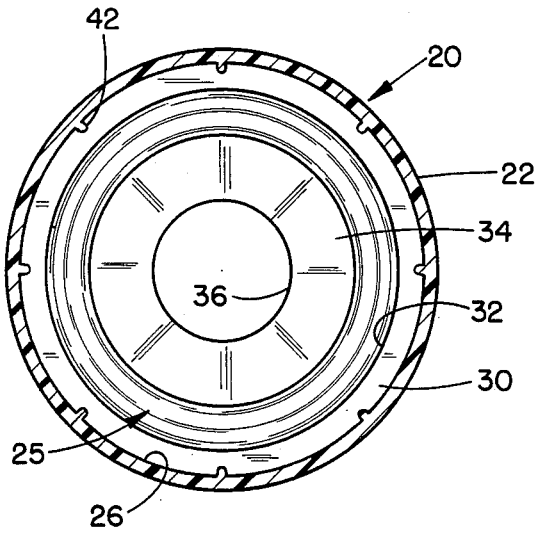
FIG. 3 is an enlarged cross sectional view taken along line 3—3 of FIG. 2, showing spaced internal ridges in the dispenser barrel.
Figure 4:
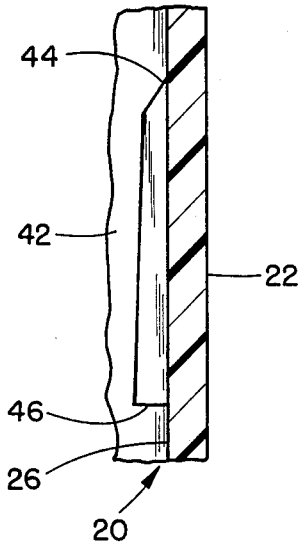
FIG. 4 is an enlarged fragmentary longitudinal sectional view taken along line 4—4 of FIG. 2.
Figure 5:
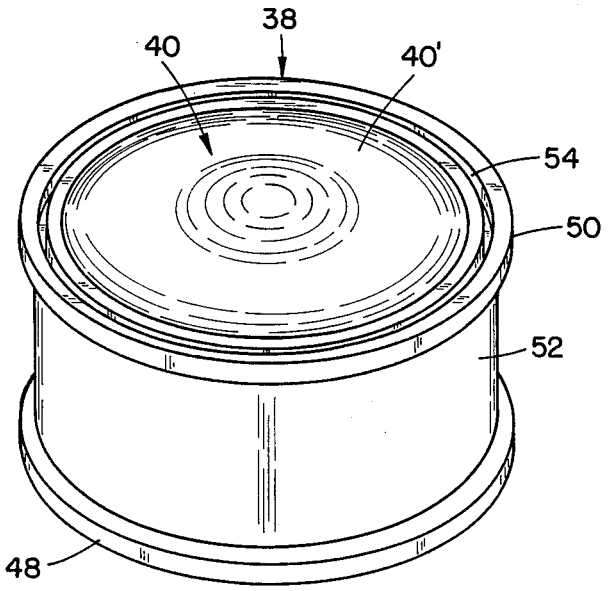
FIG. 5 is an enlarged isometric view of a piston head or seal which may be used in the fluid dispenser of FIGS. 1-4, the piston head or seal being shown in an inverted position.
Figure 6:
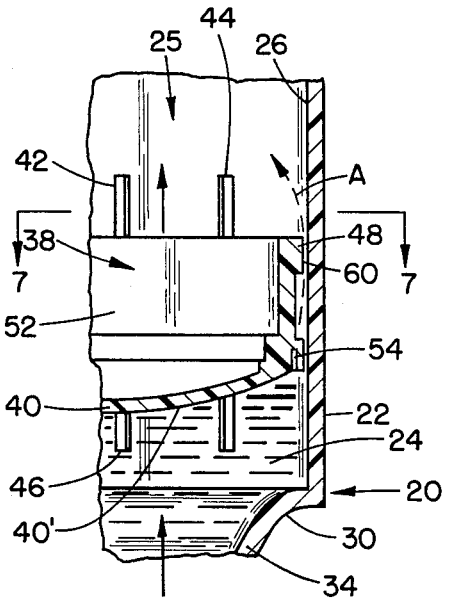
FIG. 6 is an enlarged fragmentary longitudinal sectional view similar to a portion of FIG. 2, showing the fluid dispenser partially filled with viscous fluid, with sealing head located at the air passages defined by internally projecting ridges.
Figure 7:
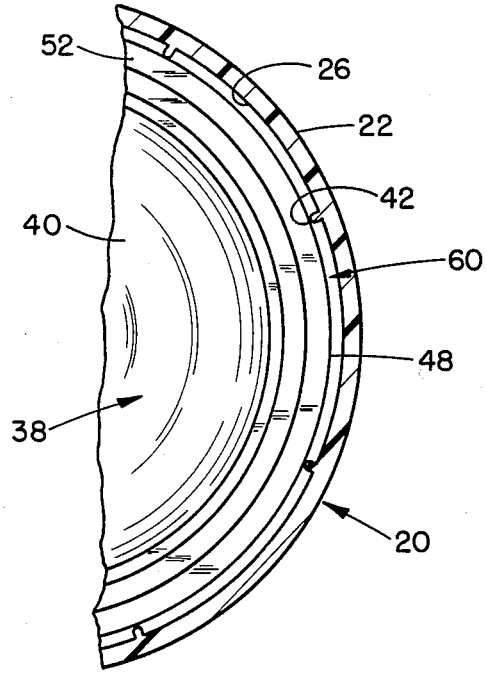
FIG. 7 is a fragmentary cross sectional view taken along line 7—7 of FIG. 6.

Referring now to the drawings wherein like reference characters designate like or corresponding parts throughout, there is illustrated in FIGS. 1-4, 6 and 7 a viscous fluid dispenser generally designated by reference numeral 20 having a cylindrical barrel 22 for receiving, containing, and dispensing or discharging a highly viscous thick fluid 24 such as oil, grease, paste, paint, caulking compound, mastic, paste, putty, or other semifluids and semiliquids. The barrel 22 has an internal cylindrical wall 26 defining a hollow chamber 25, with one end 28 of the barrel 22 open. External lugs 29 may be provided for mounting the barrel 22 as a cartridge in a caulking gun or the like. At the other end of the barrel 22 is an annular shoulder 30 where the barrel is integrally joined to the wider end 32 of a tapered nozzle 34 which is open at its forward end 36. The barrel 22 receives an axially moveable cylindrical, flexible piston head or seal 38 having a closed circular convex end wall 40. On the inner wall 26 of the barrel 22 is a plurality of straight ridges 42 spaced apart circumferentially and disposed axially of the barrel 22. The ridges 42 are slightly longer than the axial length of the piston head or seal 38. Preferably, the ridges 42 are feathered or wedge shaped, as best shown in FIGS. 2 and 4 to taper from zero thickness the upper or rear end 44 to maximum thickness at lower or forward end 46 just above the annular shoulder 30. This wedge shaped construction defines a multiplicity of ramps to guide the bottom or forward end of the flexible sealing head 38, and facilitate its axial movement along the ridges 42. In an exemplary form of the dispenser 20, the piston head 38 may be 0.5 inches in axial length at the wall 26, and the ridges 42 may be 0.510 to 1.000 inch in axial length. The ridges 42 may range from 0.005 to 0.015 inches thick sloping from minimum to maximum thickness at the forward end 46 of the barrel 22. In general, the length of the ridges 42 axially of the barrel 22, should not be more than twice the axial length of the piston head 38 at the inside wall of the barrel 22.

The piston head 38, as best shown in FIGS. 2, 5, 6, and 7, may be made of flexible plastic material to fit frictionally in sealing contact with the wall 26 at all points axially beyond the ridges 42. The material of the head 38 will yield radially at the ridges 42 when in contact therewith, but the hardness of the head 38 is such that the material of the head will not enter the passages 60 defined between the wall 26 and the head 38, to keep them unobstructed for passing entrapped air. The head 38 has two axially spaced circumferential ribs or rings 48, 50 at opposite ends of an outside wall 52 of the head 38, whose diameter is substantially the same as that of the cylindrical wall 26. A circumferential groove 54 may be provided in the outer side of the end wall 40 of the head 38, to allow slight radial compression and expansion of the flexible cylindrical wall 52 as the head 38 is pushed along the tapered ridges 42 inside the barrel 22. A piston or plunger shaft 56 may be attached to the wall 40 inside the head 38 for moving the head 38 axially of the barrel 22. In operation, the dispenser 20 is first filled with the viscous fluid 24 via the nozzle 34. This is accomplished by injecting the fluid 24 under hydraulic or pneumatic pressure into the chamber 25 via the nozzle opening 36. As the fluid 24 enters the barrel 22 it will move axially. If the piston head 38 is initially located at or close to the shoulder 30 in the barrel, a plurality of axially short, shallow, narrow, cylindrically curved passages 60 will be defined between the barrel wall 26, the wall 52 of the sealing head and the ridges 42. Even though the head 38 is flexible, its hardness is such as pointed out above, that the head 38 does not laterally enter the passages 60 at any time while filling the barrel 22, with the fluid. Thus, the passages 60 will enable entrapped air to pass therethrough rearwardly beyond the sealing or piston head 38, as indicated by arrow A in FIG. 6, and thus, the fluid 24 can abut the facing surface of the convex wall 40 of the head 38. Since the fluid 24 is highly viscous it cannot enter the axially, short, shallow, passages 60, which are extremely narrow radially of the barrel 22. This narrow dimension is only a few thousandths of an inch, which is sufficient to pass the entrapped air while blocking the viscous fluid 24. As the barrel 22 is being filled, the head 38 retracts rearwardly axially of the barrel 22 toward the open end 28. As the head 38 passes the ridges 42 it makes a full and complete frictional seal with the wall 26 inside the barrel 22. The fluid 24 is discharged on reverse, forward axial movement of the head 38 and piston or plunger shaft 56. At all times contact is maintained between the fluid 24 and the facing side 40′ of the convex wall 40, and between the head 38 and barrel wall 26, with no air entrapped and compressed, to contaminate the dose discharged from the nozzle 34. Thus, administration of the dosage required can be calibrated precisely according to the length of axial movement of the sealing or piston head 38 and no allowance need be made for undesired entrapped air or backward fluid leakage as is encountered in prior viscous fluid dispensers.

Figure 8:
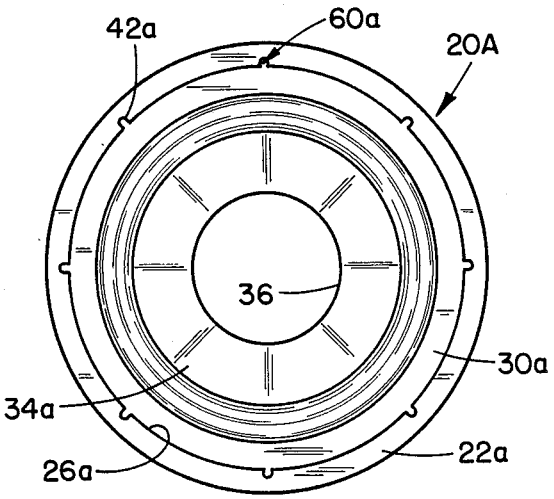
FIG. 8 is an enlarged cross sectional view similar to FIG. 3, of another viscous fluid dispenser having grooves in the barrel wall defining air passages.
Figure 9:
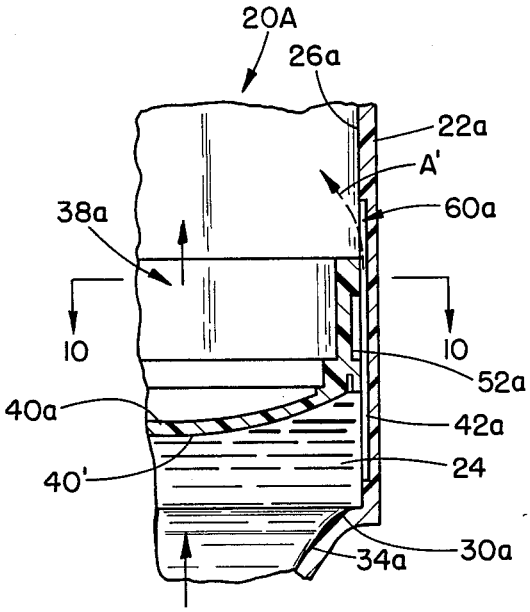
FIG. 9 is a fragmentary longitudinal sectional view, similar to FIG. 6, but showing clearly the grooves which define the air passages in the fluid dispenser.
Figure 10:
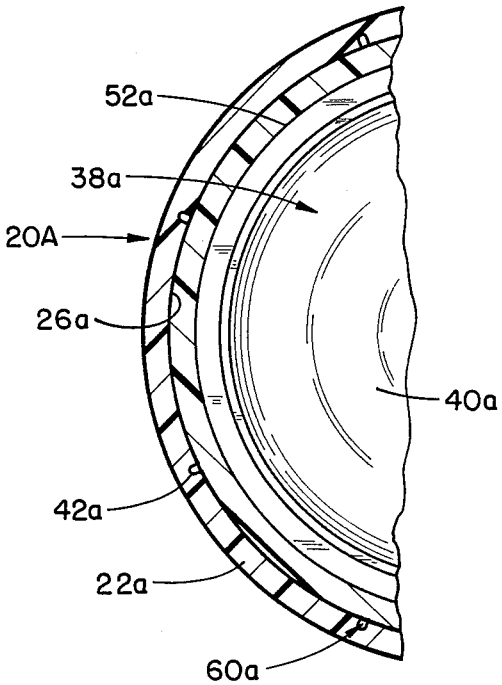
FIG. 10 is a fragmentary cross sectional view similar to FIG. 7, but taken along line 10—10 of FIG. 9.

FIGS. 8, 9, and 10 show parts of another viscous fluid dispenser 20A which is almost identical to the dispenser 20 described above in connection with FIGS. 1-7, but in which the ridges 42 have been replaced by a plurality of axially, short, shallow, narrow grooves 42a circumferentially spaced around an inside wall 26*a* of a barrel 22a near the nozzle 34. The grooves 42*a* extend axially of the barrel 22a parallel to each other near an annular shoulder 30*a*, a distance not exceeding twice the axial length of a head 38*a* at a wall 26*a* of the barrel 22*a*, but not less than 100.25% times the axial length of the head 38*a* at the wall 26*a*. Air passages 60*a* are defined between the cylindrical wall 52*a* of the piston head 38*a* and the interior barrel wall 26*a*, along and through the grooves 42*a*. When the head 38a is in the forward position as shown in FIG. 9, entrapped air is passed via the grooves 42*a* as indicated by arrow A'. The fluid 24 is injected into the barrel 22*a* via a nozzle 34*a* and abuts the forward side 40' of a wall 40*a* in the sealing head 38*a*. In one exemplary embodiment, the grooves 42*a* are 1.000 inch long, 0.015 to 0.020 of an inch wide, and about 0.015 to 0.020 of an inch wide, and about 0.005 to 0.015 inch deep. The grooves 42*a* are slightly longer than the axial length of the sealing head 38*a* at wall 26*a*, but not more than twice the length of the head 38*a* at the wall 26*a*, to insure that the passages 60*a* extend axially of the barrel just beyond the piston head 38*a*, and not more. The fine grooves 42*a* admit air but will not admit the viscous fluid 24. The head 38*a* is made of a flexible material of such hardness that no part of the head 38*a* enters the gooves 42*a* at any position of the piston head in the barrel 22*a*. At all positions of the piston head 38*a*, it makes an effective friction seal with wall 26*a* to prevent nay fluid 24*a* from passing to the rear of the piston head 38*a* even while the fluid 24 is being pushed under pressure out of the barrel 22*a* as the plunger 56 is advanced axially in the barrel 22*a*.

The fluid dispensers 20 and 20A may be made entirely of plastic, partially of plastic and partially of metal, or of other suitable materials. They may be made in various sizes depending on the dispensing applications to which they are put. For dispensing viscous medicaments, the dispensers may be made as small syringes of inexpensive plastic material, to be discarded after one use.

It should be understood that the foregoing relates to only a limited number of embodiments of the invention which have been by way of examples only, and that it is intended to cover all changes and modifications of the examples of the invention herein chosen for the purpose of the disclosure, which do not constitute departures from the spirit and scope of the invention.

What is claimed is:

1. A dispenser for a viscous fluid comprising:

a barrel having a cylindrical inside wall defining a chamber for receiving, containing and discharging a viscous fluid;

a nozzle at one end of said barrel, said nozzle having an open end spaced axially from said barrel for passing said fluid into said chamber and for discharging said fluid therefrom;

a cylindrical piston head in said barrel axially movable in said chamber, said head having an external diameter substantially equal to the internal diameter of said inside wall of said barrel to grip the same frictionally and thereby to seal said fluid in said chamber, said piston head having a closed wall facing said nozzle for pushing said fluid to discharge the same from said chamber; and means in said chamber near said nozzle defining a plurality of shallow, fine, circumferentially spaced passages between said piston head and said inside wall of said chamber, said passages comprising a multiplicity of short shallow narrow grooves in said inside wall of said barrel, said grooves being fine enough to pass air entrapped between said fluid and said closed end of said head while preventing said fluid from passing therethrough, said passages extending axially of said chamber near said nozzle a distance not exceeding twice the axial length of said piston head at said inside wall of said barrel, said distance being not less than 102% of said axial length of said piston head, to pass said entrapped air rearwardly beyond said piston head, said head having sufficient hardness to prevent said head from extending laterally into said passages to avoid obstructing the same and thereby permitting said entrapped air to pass therethrough, said hardness of said head being sufficient to prevent said fluid from leaking rearwardly of said piston at all positions of said head in said barrel, even when said head is advanced axially under pressure in said chamber to discharge said fluid from said nozzle.

2. A dispenser as defined in claim 1, wherein said short grooves are disposed parallel to each other axially of said barrel and spaced apart circumferentially of said barrel.

3. A dispenser as defined in claim 1, further comprising a piston rod engaged with said head and extending axially of said chamber for moving said head axially in said chamber.

4. A dispenser as defined in claim 3, wherein said grooves are spaced apart circumferentially of said barrel and disposed parallel to each other.

5. A dispenser as defined in claim 3, wherein the other end of said barrel has external lugs for mounting said barrel as a cartridge in a caulking gun.

* * * * *